United States Patent [19]

Matsuzaki et al.

[11] 4,284,662

[45] Aug. 18, 1981

[54] METHOD OF MANUFACTURING COLOR PICTURE TUBES

[75] Inventors: Osamu Matsuzaki; Michio Abe, both of Mobara; Koichi Mitobe, Mutsuzawa; Seikichi Tanno, Hitachi, all of Japan

[73] Assignee: Hitachi, Ltd., Tokyo, Japan

[21] Appl. No.: 5,860

[22] Filed: Jan. 23, 1979

[30] Foreign Application Priority Data

Jan. 23, 1978 [JP] Japan ..... 53-5257

[51] Int. Cl.[3] ..... B05D 5/06

[52] U.S. Cl. ..... 427/68; 427/69; 427/108; 427/124; 427/226

[58] Field of Search ..... 427/68, 69, 105, 108, 427/109, 124, 226, 404, 407.2

[56] References Cited

U.S. PATENT DOCUMENTS

| | | | |
|---|---|---|---|
| 2,910,376 | 10/1959 | Stankey et al. | 427/69 |
| 3,574,663 | 4/1971 | Schniepp | 427/69 |
| 3,582,390 | 6/1971 | Saulnier | 427/69 |
| 3,657,009 | 4/1972 | Hedler et al. | 427/69 |
| 4,122,213 | 10/1978 | Ito et al. | 427/69 |
| 4,139,657 | 2/1979 | Watanabe | 427/69 |

*Primary Examiner*—Ronald H. Smith
*Assistant Examiner*—Richard Bueker
*Attorney, Agent, or Firm*—Charles E. Pfund

[57] ABSTRACT

In a method of manufacturing a color picture tube of the type comprising the steps of coating phosphors of three primary colors on the inner surface of the face plate of the color picture tube to form dots or stripes of the phosphors, applying an acrylic resin emulsion on the dots or stripes of the phosphors to form an acrylic resin film, vapor depositing metal onto the film to form a metallic reflecting film, subjecting the acrylic resin film to a pyrolysis for decomposing it into gases, and removing the gases, the acrylic resin emulsion comprises a plurality of emulsions respectively containing conventional acrylic resin and normal butyl methacrylate resin. The normal butyl methacrylate resin is mixed with the conventional acrylic resin at a ratio of 5 to 40% by weight. According to this method, it is possible to prevent bulging of the metallic reflecting film during baking step while minimizing the number of the pin holes and cracks of the metallic reflecting film so as not to decrease the brightness of the reproduced picture.

7 Claims, 6 Drawing Figures

METHOD OF MANUFACTURING COLOR PICTURE TUBES

BACKGROUND OF THE INVENTION

This invention relates to a method of manufacturing a colour picture tube, more particularly to a film forming process performed before vapour deposition of a metallic reflecting film of a fluorescent screen.

The fluorescent screen of a colour picture tube is generally manufactured by the steps of coating a slurry of a photosensitive phosphor on the inner surface of the face plate of the tube, drying the coated film, exposing the film to light through an apertured mask such as a shadow mask, developing the exposed film with water, drying the developed film thus shaping the phosphor in the form of dots or stripes, and repeating the above-described process steps for three primary colours, thereby arranging phosphors for emanating green, blue and red colours in the form of dots or stripes of a predetermined pattern. Then, a film of acrylic resin is formed on the dots or stripes of the phosphors of three colours prior to vapour deposition of a metallic reflecting film which is provided for the purpose of improving the brightness of the fluorescent screen. According to one method of forming the acrylic resin film, an acrylic resin emulsion is used. In such emulsion film forming process, a film forming liquid is prepared by adding a suitable amount of a boric acid ester of a polyvinyl alcohol, hydrogen peroxide solution, colloidal silica, etc, to an acrylic resin emulsion. Then, the film forming liquid is coated on the phosphor dots or stripes, and then heated and dried to form an acrylic resin film. Thereafter, aluminum or the like is vapour deposited on the film to form a metallic reflecting film. The face plate formed with the fluorescent screen is then heated at a high temperature in a baking furnace to subject such an organic substance as the acrylic resin film to a pyrolysis for decomposing it into gases which are then removed. In performing the emulsion film forming process, it is important to form a metallic reflecting film capable of effficiently reflecting the light emanated by the phosphors so as to improve the brightness of the fluorescent screen. If the concentration of the acrylic resin in the film forming liquid were too low, the surface 3*a* of the resulting acrylic resin film would become irregular on account of the irregular surface of the phosphor film, as shown in FIG. 1*a*. On the other hand, if the concentration of the acrylic resin in the film forming liquid were too high, the surface 3*b* of the resulting, acrylic resin film would be flat as shown in FIG. 1*b*. In FIGS. 1*a* and 1*b*, reference numeral 1 designates a face plate, 2 particles of the phosphors, and 3*a* and 3*b* the surface of the acrylic resin film. However, when the surface of the acrylic resin film is flat and smooth and hence the surface of the metallic reflecting film is flat and smooth and free from pin holes, the gases formed by the pyrolysis of the acrylic resin during the baking step are difficult to remove because the metallic reflecting film contains less number of pin holes. As a result, the metallic reflecting film 4 would bulge as shown at 5 in FIG. 2, in which 1 designates the face plate and 6 a phosphor film. Bulging of the metallic reflecting film is generally prevented by adjusting the concentration of the acrylic resin of the flim forming liquid or the concentration of the additives including boric acid ester of a polyvinyl alcohol and hydrogen peroxide solution so that a suitable number of pin holes or cracks are formed in the metallic reflecting film vapour-deposited on the surface of the acrylic resin film. However, it is of course desirable that the metallic reflecting film should contain a small number of pin holes and cracks for the purpose of improving the brightness of the picture. Thus it is important to select the number of the pin holes and cracks such that they can efficiently prevent bulging of the metallic reflecting film due to the gas produced by organic substances while preserving the desired brightness.

SUMMARY OF THE INVENTION

It is an object of this invention to provide an improved method of manufacturing a colour picture tube utilizing an improved film forming method which can prevent bulging of a metallic reflecting film during baking step while minimizing the number of pin holes so as not to decrease the brightness of the reproduced picture.

To attain the above object, this invention takes advantage of the fact that when the number of pin holes in the metallic reflecting film is constant, that is, the gas permeability of the film is constant, the bulge of the metallic reflecting film tends to grow in proportion to the quantity of gases given off by the organic substance of the acrylic resin per unit time, especially, to the peak value of that quantity because a large amount of gases resulting from the pyrolysis is forced to pass through the fixed number of pin holes. Thus, in this invention, a plurality of acrylic resins having different pyrolysis characteristics are chosen and mixed such that the pyrolysis is carried out with a relatively low peak value.

According to this invention, there is provided a method of manufacturing a colour picture tube of the type comprising the steps of coating phosphors of three primary colours on the inner surface of the face plate of the colour picture tube to form dots or stripes of the phosphors, applying an acrylic resin emulsion on the dots or stripes of the phosphors to form an acrylic resin film, vapour depositing metal onto the film to form a metallic reflecting film, subjecting the acrylic resin film to a pyrolysis for decomposing it into gases, and removing the gases, wherein the acrylic resin emulsion comprises a mixture of a plurality of emulsions containing different acrylic resins having different pyrolysis characteristics. Preferred acrylic resins are conventional acrylic resin and normal butyl methacrylate resin and the film forming emulsion contains the normal butyl methacrylate resin mixed with the conventional acrylic resin at a ratio of 5 to 40% by weight.

DESCRIPTION OF THE PREFERRED EMBODIMENTS

Figure 1A:
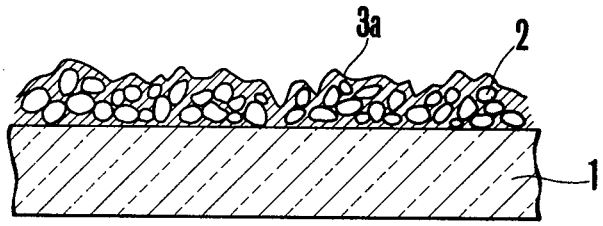
FIGS. 1*a* and 1*b* are sectional views showing acrylic resin films having irregular and smooth surfaces respectively.
Figure 1B:
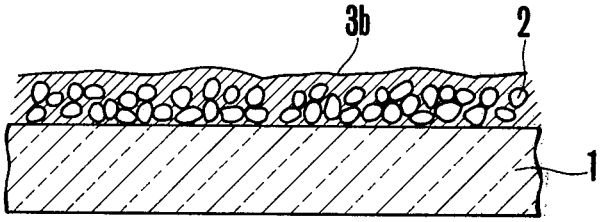
Figure 2:
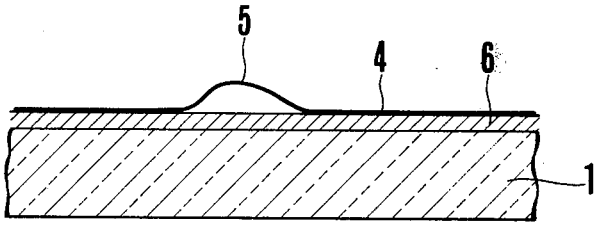
FIG. 2 is a sectional view showing a bulge of a metallic reflecting film.
Figure 3:
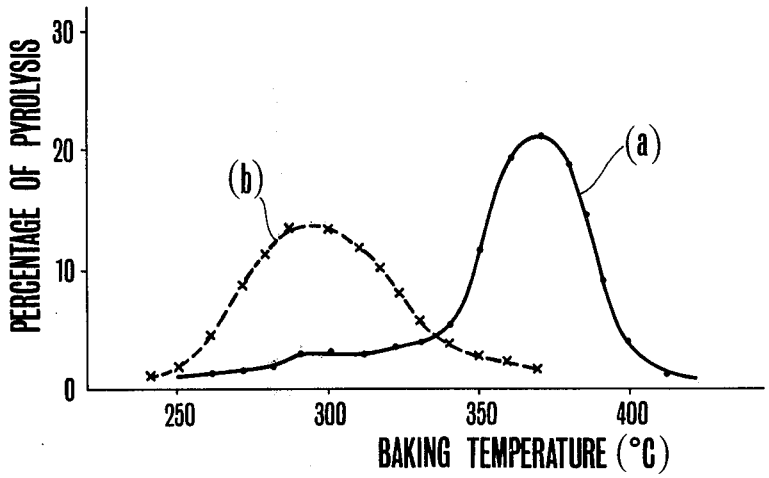
FIGS. 3 and 4 are graphs showing pyrolysis characteristics of different types of acrylic resins.
Figure 4:
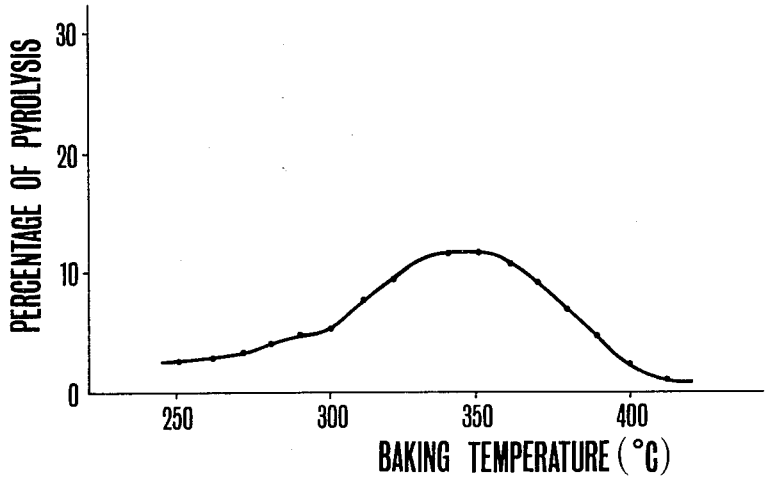

Acrylic resin conventionally utilized for preparing an emulsion film forming liquid is a copolymer of methyl methacrylate and ethyl acrylate and percentage of pyrolysis of this acrylic resin at various temperatures is shown by curve (a) in FIG. 3. To prevent bulging of the metallic reflecting film, it is necessary to decrease the peak value of the percentage of pyrolysis. It was found that it is advantageous to use a mixture of a plurality of resins having different pyrolysis characteristics where the quantity of the resin and the baking condition are maintained constant. The pyrolysis characteristic of normal butyl resin (n-BMA resin) is shown by curve (b) in FIG. 3. As shown its pyrolysis temperature is lower than that of a copolymer of methyl methacrylate and ethyl acrylate. When both resins are mixed together at the same ratio, the mixture has a pyrolysis characteristic as shown in FIG. 4 which has a low peak value, thus effectively preventing bulging of the metallic reflecting film. Thus, use of a mixture of emulsions of two type acrylic resins having different pyrolysis characteristics for forming films is effective to prevent bulging of the metallic reflecting films. Instead of using a mixture of emulsions containing different type acrylic resins, where two types of acrylic resins are copolymerized, it will have a different pyrolysis characteristic from that of the mixed emulsion. Even if the copolymer is arranged to have the intended pyrolysis characteristic, the film forming temperatures are greatly different from those required for the resins utilized to prepare film forming emulsions. Furthermore, as the mechanical characteristics of the films prepared with such copolymers vary greatly, such copolymers can not be used actually.

In the following, the characteristics of the films prepared from a mixture of two types of acrylic resin emulsions will be described in detail. Table 1 below compares various characteristics of an acrylic resin emulsion generally used in preparing films for colour picture tubes and of an n-BMA resin emulsion.

TABLE 1

| type of emulsion | emulsion generally used | n-BMA resin emulsion |
|---|---|---|
| peak of pyrolysis temperature | 370° C. | 300° C. |
| Film hardness (Barcoal hardness) | 74 | 40 |
| tensile strength of film | 340Kg/cm$^2$ | 100Kg/cm$^2$ |
| elongation of film | 18% | 204% |
| minimum film forming temperature | 41–43° C. | 39–41° C. |

Figure 5:
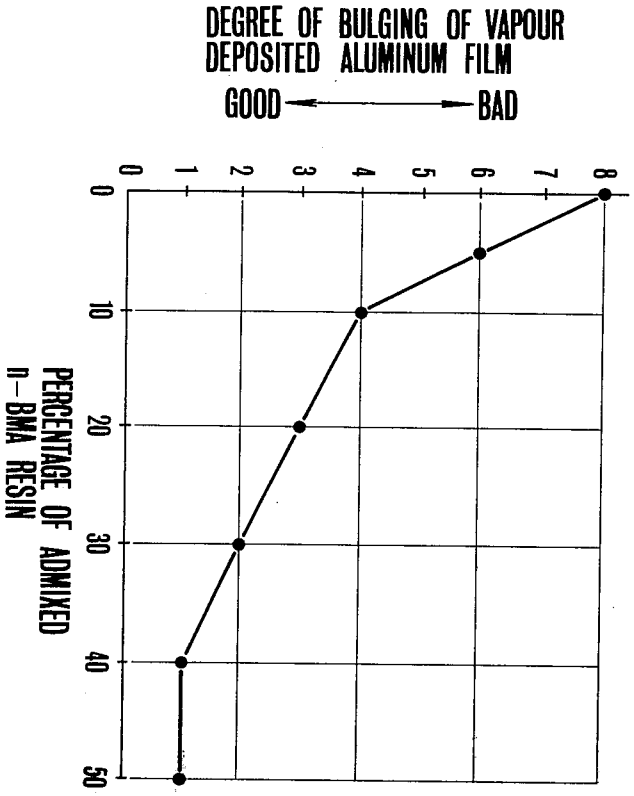
FIG. 5 is a graph showing the relationship between the degree of bulging of aluminum vapour-deposited films and percentage of admixing n-BMA resin with a conventional acrylic resin.

TABLE 1-continued

Where a mixture of these two types of emulsions is used to form films, the relationship between the percentage of the n-BMA resin and the degree of bulging of the reflecting films formed by vapour deposition of aluminum is shown in FIG. 5, in which "good" and "bad" show the degree of bulging in an arbitrary scale. As shown, when the percentage of the n-BMA resin exceeds 5% by weight, the advantage of admixing becomes remarkable. However, use of the n-BMA resin beyond 50% by weight should be avoided because the characteristics of the resulting films degrade greatly as shown in Table 2.

TABLE 2

| ratio of admixing by weight | peak percentage of pyrolysis | elongation of film | tensile strength of film | minimum film forming temperature | remark |
|---|---|---|---|---|---|
| 0% | 20% | 18% | 34 OKg/cm$^2$ | 42° C. | conventional acrylic resin emulsion alone |
| 5% | 18% | 25% | 325Kg/cm$^2$ | 42° C. | |
| 30% | 11% | 70% | 233Kg/cm$^2$ | 42° C. | |
| 40% | 11% | 83% | 200Kg/cm$^2$ | 42° C. | |
| 50% | 11% | 91% | 174Kg/cm$^2$ | 40° C. | |
| 70% | 12% | 167% | 112Kg/cm$^2$ | 38° C. | |
| 100% | 14% | 204% | 100Kg/cm$^2$ | 38° C. | n-BMA resin emulsion alone |

In carrying out the method of this invention, the advantageous ratio of the n-BMA resin to the prior art acrylic resin which has usually been used to form films ranges from 5 to 40% by weight. It was found that this ratio can efficiently prevent bulging of the aluminum vapour-deposited reflection film without unduly imparing the brightness of the fluorescent screen.

What is claimed is:

1. In a method of manufacturing a colour picture tube of the type comprising the steps of coating phosphors of three primary colours on the inner surface of the face plate of the colour picture tube to form dots or stripes of the phosphors; applying an acrylic resin emulsion on said dots or stripes of the phosphors to form an acrylic resin film; vapour depositing metal onto said film to form a metallic reflecting film; subjecting said acrylic resin film to a pyrolysis for decomposing it into gases; and removing the gases; the improvement wherein said acrylic resin film-forming emulsion consists essentially of a mixture of a plurality of film-forming emulsions each consisting essentially of a different acrylic resin having a different pyrolysis characteristic, wherein one of the emulsions of said mixture consists essentially of a first film-formimg acrylic polymer having a peak pyrolysis temperature lower than that of a second acrylic film-forming polymer contained in a second emulsion of said mixture and said first polymer is present in an amount of 5 to 40% by weight based on the total weight of said film-forming polymers, whereby said mixture results in an acrylic film-forming emulsion the film formed by which has a pyrolysis characteristic that is different from the pyrolysis characteristic of that formed by any of the emulsions forming said mixture.

2. A method according to claim 1 wherein the ratio of said different acrylic resins is selected such that the quantity of said decomposed gas per unit time is less than a predetermined value.

3. A method according to claim 2 wherein said different acrylic resins comprise normal butyl methacrylate resin and at least one other acrylate resin.

4. A method according to claim 3 wherein the normal butyl methacrylate resin is mixed at a ratio less than 50% by weight.

5. A method according to claim 3 wherein the normal butyl methacrylate resin is mixed at a ratio of from 5 to 40% by weight.

6. A method according to claim 1 wherein said acrylic resin emulsion further contains boric acid ester of a polyvinyl alcohol, hydrogen peroxide solution and colloidal silica.

7. A method according to claim 1 wherein said first film-forming acrylic polymer is poly(n-butyl methacrylate) and said second acrylic film-forming polymer is poly(methyl methacrylate-co-ethyl acrylate).

* * * * *

UNITED STATES PATENT AND TRADEMARK OFFICE

CERTIFICATE OF CORRECTION

PATENT NO. : 4,284,662

DATED : August 18, 1981

INVENTOR(S) : Osamu Matsuzaki et al

It is certified that error appears in the above—identified patent and that said Letters Patent is hereby corrected as shown below:

Column 4, Table 2, First entry under the column titled:

tensile strength of film change " 34 OKg/cm$^2$ " to -- 340Kg/cm$^2$ --.

Signed and Sealed this

*Twenty-fifth* Day of *May 1982*

[SEAL]

*Attest:*

*Attesting Officer*

GERALD J. MOSSINGHOFF

*Commissioner of Patents and Trademarks*